US006064292A

United States Patent [19]

Pongracz

[11] Patent Number: 6,064,292

[45] Date of Patent: May 16, 2000

[54] ELECTROSTATIC DISCHARGE PROTECTED FUSE AND FUSE HOLDER

[75] Inventor: David J. Pongracz, Bangor, Pa.

[73] Assignee: Lucent Technologies Inc., Murray Hill, N.J.

[21] Appl. No.: 09/224,538

[22] Filed: Dec. 31, 1998

[51] Int. Cl.[7] ..... H01H 85/044; H01H 85/30

[52] U.S. Cl. ..... 337/224; 337/241; 337/222; 337/244; 337/267; 337/199

[58] Field of Search ..... 337/241, 222, 337/223, 224, 244, 251, 267, 268, 256, 199, 17, 19, 28, 221, 32

[56] References Cited

U.S. PATENT DOCUMENTS

| | | | |
|---|---|---|---|
| 3,828,290 | 8/1974 | Kawiecki | 337/186 |
| 3,975,664 | 8/1976 | Baumbach | 317/66 |
| 4,086,648 | 4/1978 | Hines et al. | 361/124 |
| 4,161,762 | 7/1979 | Scheihauer | 361/124 |
| 4,500,862 | 2/1985 | Shedd | 337/32 |
| 4,714,949 | 12/1987 | Simmons et al. | 357/23.13 |
| 5,910,878 | 6/1999 | Mello et al. | 361/212 |

*Primary Examiner*—Leo P. Picard
*Assistant Examiner*—Anatoly Vortman

[57] ABSTRACT

An electrostatic discharge ground path for a fuse installable in a fuse holder includes an area of metallization on at least one insulating surface of the fuse extending from an exposed surface of the fuse to a contact area within the fuse holder.

7 Claims, 1 Drawing Sheet

ELECTROSTATIC DISCHARGE PROTECTED FUSE AND FUSE HOLDER

BACKGROUND OF THE INVENTION

This invention relates to sensitive electronic equipment and, more particularly, to an improved arrangement for protecting such equipment from electrostatic discharge.

When a person walks across a carpet, an electrostatic charge can build up on the person's body. This charge can reach a potential on the order of 15,000 volts. If the person approaches a conductive ground path, the charge can jump across a gap between the person's body and the path. In most situations, this does not present any problems. However, if the electrostatic discharge passes through a sensitive electronic component, this can lead to catastrophic failure of the component.

In the past, electronic equipment was typically contained within a metal conductive housing. Therefore, when a person approached the equipment, any electrostatic discharge would jump to the housing and then to ground, bypassing the sensitive electronic components. However, in recent years, more and more such electronic equipment is contained in a plastic insulative housing. The plastic housing eliminates the major path to ground previously provided by the metal housing. With such equipment, there is usually associated one or more fuses which are accessible on the exterior of the plastic housing. One such type of fuse has an indicator window on a visible surface through which can be determined the state of the internal fuse element. Both the window and the remainder of the fuse body are formed of insulative material. The provision of this window results in a small air gap between the window and the rest of the fuse body. Accordingly, an electrostatic discharge can pass through the air gap and reach the internal fuse element, from which it can pass to a sensitive electronic component. Although the electrostatic discharge has a potential on the order of 15,000 volts, its current is very small so that it does not destroy the fuse element. However, the electrostatic discharge possesses enough energy to destroy a sensitive electronic component. It would therefore be desirable to provide an arrangement for preventing an electrostatic discharge from reaching a fuse element within a fuse body.

Attempts in the past to solve this problem have included the placing of a metal door in front of the fuse. However, this obstructs the view of the indicator window. It would therefore be desirable to provide an electrostatic discharge path which does not obstruct the fuse body indicator window.

SUMMARY OF THE INVENTION

In accordance with the principles of this invention, there is provided an electrostatic discharge ground path for a fuse installable in a fuse holder which comprises an area of metallization on at least one insulating surface of the fuse extending from an exposed surface of the fuse to a contact area which is within the fuse holder when the fuse is installed therein.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
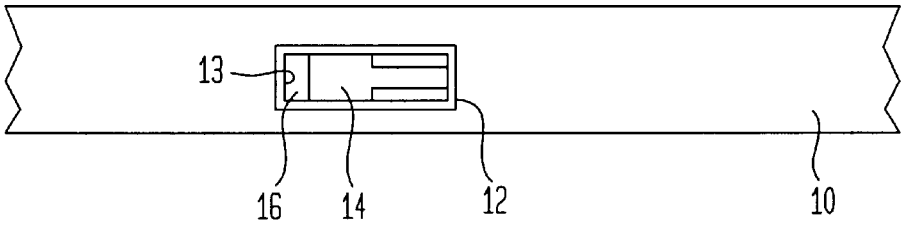
FIG. 1 (PRIOR ART)
FIG. 1 is a front elevational view of an electronic equipment face plate according to the prior art showing a fuse of the type with which the present invention is concerned installed in a fuse holder.

FIG. 1 shows a plastic face plate 10 of a housing for electronic components having permanently installed therein a fuse holder 12 having an internal cavity 13. As is conventional in the prior art, a fuse 14 is installable in and removable from the fuse holder 12, with a portion of the fuse 14 extending outwardly from the fuse holder 12 so that it may be gripped for removal therefrom. The fuse 14 is of the type having a clear indicator window 16. Within the fuse 14 is a fuse element having an indicator portion arranged to be hidden from the window 16 when it is intact and visible through the window 16 when the fuse element is destroyed as a result of excessive current therethrough. Accordingly, it is readily apparent when the fuse 14 has to be replaced. If a person having an electrostatic charge built up on his or her body approaches sufficiently close to the face plate 10, the closest conductive path will be the fuse element within the fuse 14. Typically, there is an air gap between the window 16 and the insulative fuse body of the fuse 14. This air gap provides a path for an electrostatic discharge (i.e., a spark) to jump from the person's body to the internal fuse element. The current of this electrostatic discharge is too small to destroy the internal fuse element, but it can pass along the fuse element to the power leads of the circuitry within the housing and can cause catastrophic failure of sensitive electronic components therein.

Figure 2:
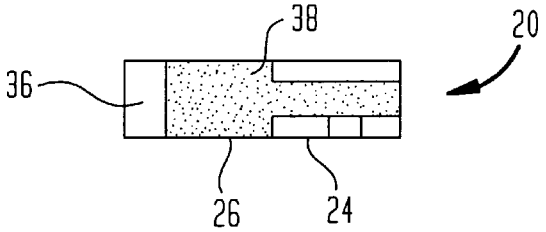
FIG. 2 is a front view of a fuse showing an area of metallization according to the present invention.
Figure 3:
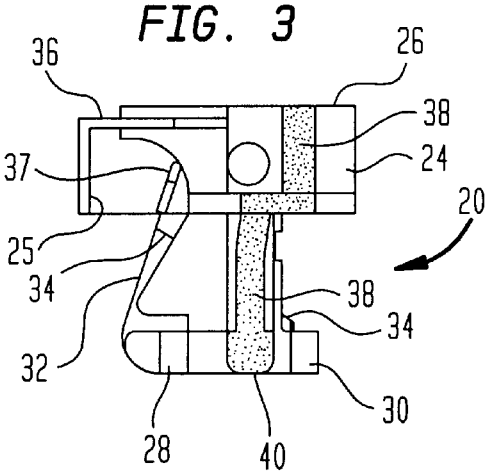
FIG. 3 is a side view of the fuse shown in FIG. 2 showing an area of metallization according to the present invention.
Figure 4:
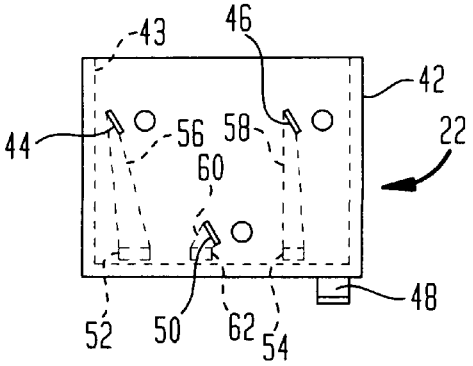
FIG. 4 is a side view of a fuse holder with an added ground contact according to the present invention.

FIGS. 2 and 3 illustrate an improved fuse 20 according to the present invention which is a modified version of the fuse 14 and FIG. 4 illustrates an improved fuse holder 22 which is a modified version of the fuse holder 12. The fuse 20 includes an insulative fuse body 24 with an interior cavity 25 and a face surface 26. A pair of conductive fuse power contacts 28, 30 are on the exterior of the fuse body 24 remote from the face surface 26. A fuse element is in the interior cavity of the fuse body 24 and in contact with the power contacts 28, 30. Illustratively, the fuse element includes a leaf spring like conductive piece 32 connected to the power contact 28 and a fusible link 34 connected to the power contact 30. The fusible link 34 is formed with a bend at its distal end which engages the piece 32 to bias the piece 32 in a clockwise direction, as viewed in FIG. 3. When the fusible link 34 is destroyed by excessive current therethrough, it releases the piece 32, which moves in a counterclockwise direction. The fuse 20 further includes a clear indicator window 36, made of a plastic insulative material. When the fusible link 34 is destroyed and the piece 32 is allowed to move in a counterclockwise direction, the indicator portion 37 on its distal end becomes visible through the indicator window 36. Typically, the indicator portion 37 of the piece 32 is colored so that it is clearly visible through the indicator window 36 after the fusible link 34 has been destroyed.

The aforedescribed fuse is in accordance with the prior art. According to the present invention, an area of metallization 38, as denoted by the stippling, is provided on the face surface 26 of the fuse 20, but stops short of covering the indicator window 36. This area of metallization 38 continues down the side of the fuse body 24, as shown in FIG. 3, to a ground contact 40 remote from the face surface 26. The area of metallization 38 can be provided by metallizing the plastic fuse body 24, by providing a metal stamping, or by other appropriate techniques.

The fuse holder 22 includes an insulative fuse holder body 42 having a cavity 43 for receiving the fuse 20 with the face surface 26 exposed. Inside the fuse holder 22 are a pair of conductive fuse holder power contacts 52, 54 which engage with respective ones of the fuse power contacts 28, 30 when the fuse 20 is installed in the fuse holder 22. Conductive traces 56, 58 within the cavity of the fuse holder body 42 extend from those fuse holder power contacts to respective terminal pins 44, 46 which extend through the body 42 so that when the fuse holder 22 is installed within an equipment housing, connections can be made to the terminal pins 44, 46. It is noted at this point that the side of the fuse holder 22 shown in FIG. 4 is the reverse of the side of the fuse holder 22 that would be visible if the fuse 20 as viewed in FIG. 3 is installed in the fuse holder 22. The fuse holder 22 also includes another terminal pin 48 which is connected to a circuit trace running along the side wall of the cavity of the fuse holder body 42 and which is engaged by the piece 32 of the fuse 20 when the fusible link 34 is destroyed.

The aforedescribed fuse holder 22 is in accordance with the prior art. According to the present invention, a ground terminal pin 50 is provided which extends through the fuse holder body 42. In conductive engagement with the terminal pin 50, as by a conductive trace 60 within the cavity of the fuse holder body 42, is a conductive fuse holder ground contact 62. This ground contact 62 is engaged by the ground contact 40 of the fuse 20 when the fuse 20 is installed in the fuse holder 22.

Thus, when the fuse 20 and fuse holder 22 are installed in the face plate 10, an electrostatic discharge carried by a person will seek the path of least resistance and will jump to the area of metallization 38 on the face surface 26, rather than through the air gap provided by the indicator window 36. The electrostatic discharge will pass along the area of metallization 38 to the ground contact 40 and then to the ground terminal pin 50 of the fuse holder 22. Within the electronic equipment enclosure, the ground terminal pin 50 is connected to a chassis ground, which bypasses all of the electronic components of the equipment, thereby preventing any electrostatic discharge from reaching a sensitive electronic component.

Accordingly, there has been disclosed an improved arrangement for protecting sensitive electronic components from electrostatic discharge. While an illustrative embodiment of the present invention has been disclosed herein, it is understood that various adaptations and modifications to the disclosed embodiment are possible, and it is intended that this invention be limited only by the scope of the appended claims.

What is claimed is:

1. An electrical fuse assembly comprising:

a fuse including:

an insulative fuse body having an interior cavity and a face surface;

a pair of conductive fuse power contacts on the exterior of said fuse body remote from said face surface;

a fuse element in said fuse body cavity in contact with said fuse power contacts, said fuse element having an indicator portion arranged to be in a first location of said fuse body cavity when said fuse element is intact and in a second location of said fuse body cavity when said fuse element is destroyed as a result of excessive current therethrough; and an indicator window on said fuse body face surface providing a view of said second location of said fuse body cavity; and a fuse holder including:

an insulative fuse holder body having a cavity for receiving said fuse with said fuse body face surface being exposed;

a pair of conductive fuse holder power contacts secured inside said fuse holder body cavity for engagement with corresponding fuse power contacts when said fuse is installed in said fuse holder cavity; and a pair of power terminal pins extending through said insulative fuse holder body into engagement each with a respective one of said fuse holder power contacts;

WHEREIN THE IMPROVEMENT COMPRISES:

a conductive fuse holder ground contact inside said fuse holder body cavity;

a ground terminal pin extending through said fuse holder body into engagement with said ground contact;

a conductive fuse ground contact on the exterior of said fuse body remote from said face surface and engaging said fuse holder ground contact when said fuse is installed in said fuse holder cavity; and an area of metallization on the exterior of said fuse body, said area of metallization covering a portion of said fuse body face surface without covering said indicator window, said area of metallization extending into contact with said fuse ground contact.

2. An electrical fuse assembly comprising:

a fuse holder having at least one ground terminal; and a fuse having a pair of power contacts and at least one ground contact, the fuse being disposable within said fuse holder such that the at least one ground terminal engages with the at least one ground contact, wherein the fuse has a fuse body within which is a fuse element visible through a window on the fuse body.

3. The electrical fuse assembly of claim 2 wherein said fuse further has an area of metallization permanently affixed on a surface of said fuse extending from the at least one ground contact.

4. The electrical fuse assembly of claim 2 wherein the fuse holder has at least one conductive trace extending from the at least one ground terminal to a fuse holder ground contact.

5. The electrical fuse assembly of claim 4 wherein the fuse ground contact engages with the fuse holder ground contact when the fuse is disposed within the fuse holder.

6. The electrical fuse assembly of claim 2 wherein the fuse further has an area of metallization permanently affixed on an external surface of the fuse body extending from the at least one ground contact, the area of metallization not covering the window.

7. The electrical fuse assembly of claim 2 wherein an electrical ground path is formed by the engagement of the at least one ground terminal with the at least ground contact, which ground path creates a path of least resistance for an electrostatic discharge applied to the fuse.

* * * * *